United States Patent [19]

Alvarsson

[11] Patent Number: 4,712,943

[45] Date of Patent: Dec. 15, 1987

[54] METHOD AND MACHINE FOR LEVELLING CONCRETE WHEN CASTING LARGE CONCRETE AREAS

[76] Inventor: Yngve Alvarsson, Skogshemsvägen 7B, S-141 41 Huddinge, Sweden

[21] Appl. No.: 824,691

[22] PCT Filed: Apr. 4, 1985

[86] PCT No.: PCT/SE85/00162

§ 371 Date: Nov. 29, 1985

§ 102(e) Date: Nov. 29, 1985

[87] PCT Pub. No.: WO85/04686

PCT Pub. Date: Oct. 24, 1985

[30] Foreign Application Priority Data

Apr. 9, 1984 [SE] Sweden ..... 8401977

[51] Int. Cl.[4] ..... E01C 19/29; E01C 21/00

[52] U.S. Cl. ..... 404/75; 404/97; 404/103; 404/117

[58] Field of Search ..... 404/72, 75, 97, 103, 404/113, 118, 117, 122; 425/63, 64, 85, 218, 456, 458; 264/31; 52/749; 15/235.4

[56] References Cited

U.S. PATENT DOCUMENTS

| | | | |
|---|---|---|---|
| 699,694 | 5/1902 | Longenecker | 404/122 |
| 1,945,145 | 1/1934 | Gordon | 404/75 |
| 2,025,703 | 12/1935 | Baily et al. | 404/117 |
| 3,515,042 | 6/1970 | Austin | 404/103 |
| 4,088,077 | 5/1978 | von Beckmann | 404/117 X |

FOREIGN PATENT DOCUMENTS

| | | | |
|---|---|---|---|
| 628162 | 11/1961 | Italy | 425/64 |
| 672675 | 5/1952 | United Kingdom | 404/103 |
| 567800 | 8/1977 | U.S.S.R. | 425/63 |

*Primary Examiner*—James A. Leppink
*Assistant Examiner*—Matthew Smith
*Attorney, Agent, or Firm*—Sughrue, Mion, Zinn, Macpeak & Seas

[57] ABSTRACT

A method for levelling and smoothing concrete when concreting large areas. According to the method a machine which is so constructed that it floats lightly even on highly fluid concrete mass and thus normally exerts a very low surface pressure against the substratum, is caused to move over the surface of the concrete while smoothing and levelling the same as a result of rolling motion between the surface and a belt of the machine in contact therewith. The smoothing or levelling effect of the belt can be amplified by vibrating a plate supporting the belt. The concrete may also be subjected to vacuum treatment at the same time as levelling or smoothing the concrete. The invention also relates to a machine for carrying out the method.

9 Claims, 10 Drawing Figures

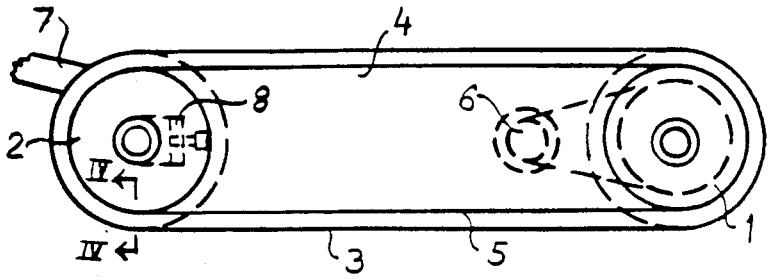
FIG.1
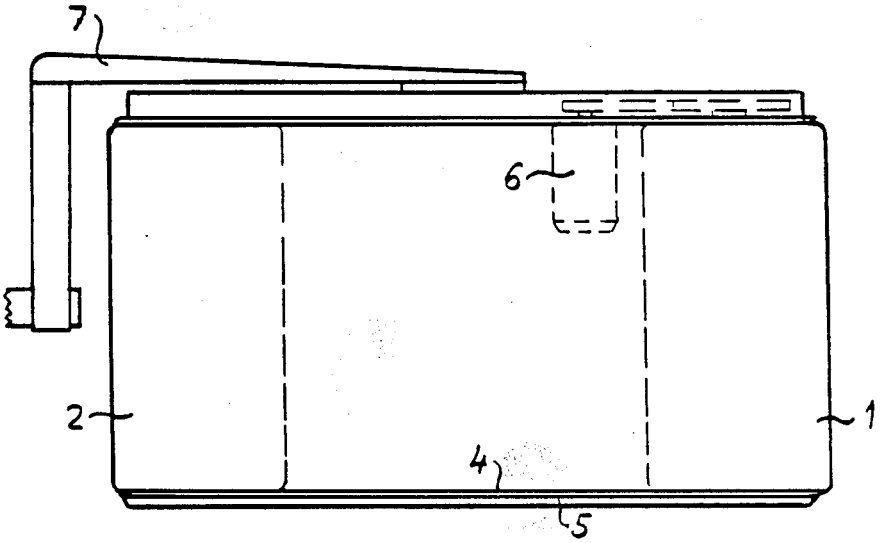
FIG.2
FIG.3
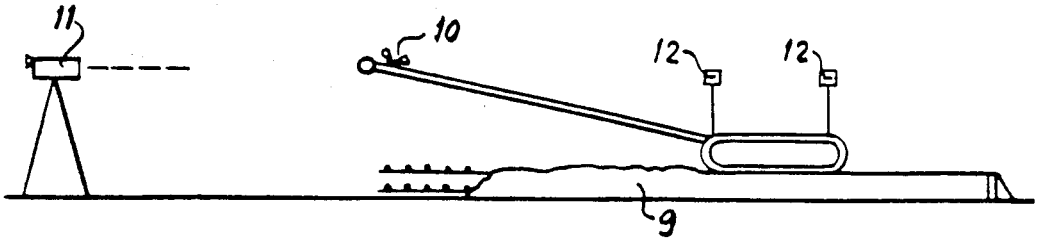

FIG.5
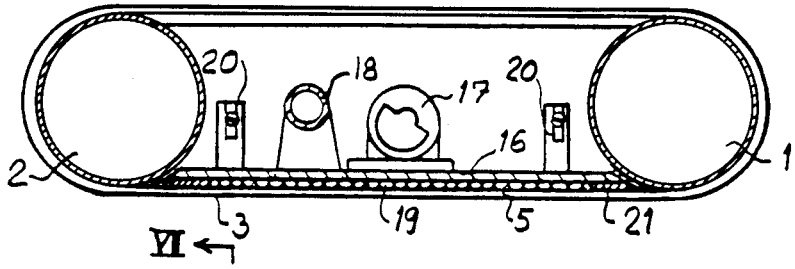
FIG.6
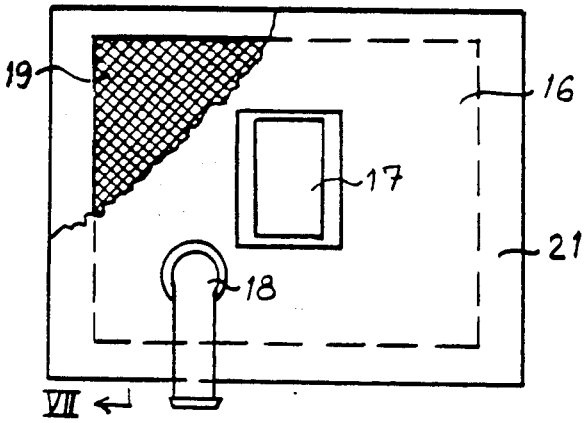
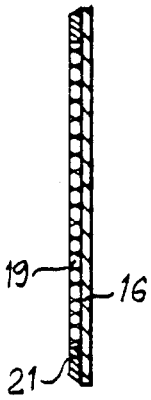
FIG.7
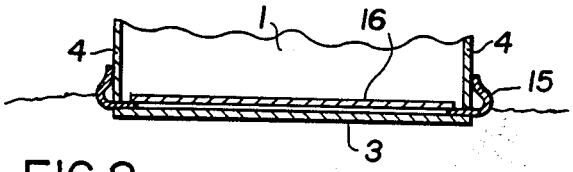
FIG.8
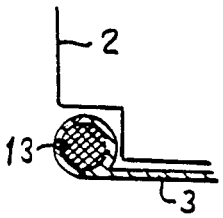
FIG.4A
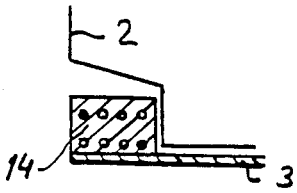
FIG.4B
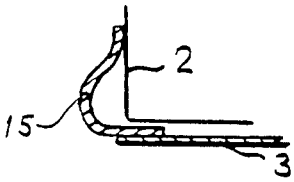
FIG.4C

METHOD AND MACHINE FOR LEVELLING CONCRETE WHEN CASTING LARGE CONCRETE AREAS

The present invention relates to a method of levelling or smoothing concrete in the casting of large concrete areas, and to a machine intended herefor, said machine being adapted for movement over a concrete surface without the use of screed guide support means or like devices.

Concrete is today normally smoothed and levelled with the aid of finishing boards which run on a screed guide system comprising a plurality of beams. The assembly and dismantling of such screed guide systems is both laborious and time consuming, and hence expensive. When there is no particular demand for the surface of the concrete to be truly smoothed, the use of such a screed guide can be dispensed with, while in other cases the use of such a guide may prove difficult or impossible. The task of levelling or smoothing concrete by hand without the aid of screed guide support means is today effected with the use of a scraper or scraper-like implements, which are heavy to handle.

It is known to remove excess or surplus water from concrete surfaces by means of so-called vacuum treatment processes, in order to improve the quality of concrete in a concreted area and to accelerate hardening of the concrete. With present day vacuum-treatment techniques the concrete is treated in sections, with the aid of vacuum mats or plates which are moved from position to position over the concrete surface.

In addition to the aforesaid suction mats it is known from Swedish Pat. No. 137,965 to use in such vacuum treatment processes a device in the form of a small suction box adapted for movement over the surface of the concrete. When using this device it is only possible to vacuum treat a very small area of the concrete surface at a time; alternatively the device may possibly be used for continuous vacuum treatment while being moved over a very flat concrete surface. This latter alternative, however, assumes that the vacuum is maintained at an extremely low level, see for example Column 1, lines 44–46. A vacuum of this low level results in an excessively poor vacuuming effect when seen from a practical viewpoint. If a higher vacuum is used, however, the device is pressed firmly against the surface of the concrete by the atmospheric pressure and cannot be moved thereacross.

The German patent specification No. 709 278 describes a compacting vibratory device in the form of an extremely heavy belt-driven earth vibrator. This is intended for compressing and compacting masses in the construction of dams and like structures for example, and cannot be used to level or smooth fluid concrete.

The U.S. Pat. No. 2,025,703 describes a relatively heavy rotatable vibratory roller operative to compact a plastic or pliable stratum. According to FIGS. 6–11 of this patent it is possible to use two mutually connected rollers, with or without encircling belts. These rollers lie very close together and because of their weight function as a surface compactor. The sole purpose for using two rollers is to prevent material from flowing up behind the first, vibrating roller, cf. page 2, Col. 2, lines 9–17. The described device is adapted for use in conjunction with a plastic or pliable material which was generally used at the time of this patent. The modern concrete grades used today, however, have a much higher water content or contain plasticizers, which render the concrete grades highly fluid so that they behave almost as a liquid. Apparatus which operate in accordance with the aforesaid surface compacting principles cannot be used with concrete of such high fluid consistency, such concrete being far from plastic or pliable.

An object of the present invention is to provide a technique with which even highly fluid concrete masses can be levelled and smoothed without any appreciable manual contribution thereto and without the use of screed guide supports for strikers, punners or like devices. This object is achieved in accordance with the invention by smoothing or levelling the concrete with the aid of a machine so constructed that it floats lightly even on a highly fluid concrete surfaces and thus normally exerts a very low surface pressure on the concrete stratum. The machine is moved over the surface of the concrete while smoothing and levelling the same as the result of rolling motion between the surface of the concrete and a belt arranged on the machine and in contact with said surface. Since this eliminates all relative movement between the surface of the concrete and the smoothing or levelling machine, the machine can be very easily moved across said surface.

The machine rolls over any elevations, lumps or raised areas on the surface of the concrete and, as a result thereof, the concrete located in these elevated or raised areas is dispersed in all directions by a force acting from above, and fills out adjacent cavities and pits. Thus, the machine according to the invention does not function according to any compacting technique, in which mass is pressed in front of a compacting drum. Because a machine constructed in accordance with the invention is highly buoyant, it will float very lightly over the surface of the concrete, as opposed to a surface compacting device, wherewith the device is able to pass up and over elevated areas and also to press-out laterally the concrete present therein.

In order to improve the smoothing/levelling efficiency of the machine, it may be provided with vibratory means for vibrating a plate supporting the belt. Such vibrations may be created with the aid of vibratory means controlled automatically by level sensing devices.

In order to vacuum treat the concrete while smoothing or levelling the surface thereof, the belt may have the form of a fabric strainer or filter which is at least partially supported by a suction box. Since this strainer does not slide relative to the surface of the concrete, but is placed thereupon and removed therefrom due to movements in the vertical direction, it is possible to apply a high vacuum constantly without the vacuum having any appreciable influence on the force required to move the device over the surface of the concrete. It may possibly be suitable to interrupt briefly movement of the machine across said surface, in order to achieve effective vacuum treatment.

Other characteristic features of the invention will be apparent from the following claims.

A machine according to the invention may have the form of a small hand-operated machine or a driveable vehicle having the same width as the joint spacing over which the concrete is cast. When concreting roads for example, the machine according to the invention can thus be driven continuously behind a concrete laying machine, in order to level, smooth, vibrate and vacuum-treat the concrete in one continuous operation.

The invention will now be described in more detail with reference to the accompanying drawings.

FIG. 1 is a schematic side view of one embodiment of a machine according to the invention.

FIG. 2 is a top plan view of the machine illustrated in FIG. 1.

FIG. 3 illustrates the use of a machine according to FIGS. 1 and 2.

FIGS. 4A–4C illustrate different sealing arrangements for the belt used in a machine according to the invention.

FIG. 5 is a sectional view of a further embodiment of a machine according to the invention.

FIG. 6 illustrates part of the machine shown in FIG. 5, seen from above.

FIG. 7 is a sectional view taken on the line VII—VII in FIG. 6.

FIG. 8 is a sectional view taken on the line VIII—VIII of FIG. 5.

The machine illustrated in FIGS. 1 and 2 comprises two drums 1 and 2 around which extends an endless belt 3. In order to obtain good bouyancy the distance between the drums or rollers should be relatively large and should correspond at least to two to three times the roller diameter. The belt 3 is provided with a flange or sealing lip 5 which seals against the concrete and a side plate 4 on the machine and its drums. The belt 3, which is made for example of steel, rubber or a plastics material, is driven with the aid of a motor 6, which drives the drum 1. The reference 7 identifies an operating handle while the reference 8 identifies a mechanism for tensioning the belt 3. Immediately above the lower run of the belt 3, between the drums 1 and 2 is a belt support plate (not shown) which provides the belt with the requisite planar supporting surface.

A machine according to the invention can be made extremely light in weight, so that it will float as lightly as a flat-bottomed boat, even on highly fluid concrete.

FIG. 3 illustrates the use of a machine according to the invention when casting an area with reinforced concrete 9. The machine is provided with control means 10 for controlling the motor 6 such as to cause the machine to move forwards or backwards through the rolling action of the belt 3 on the concrete. Thus, it is not necessary for the operator to exert force on the machine in order to move the same. The level of the concrete surface can be monitored with the aid, for example, of laser equipment 11 arranged to transmit a laser beam received by a receiver 12 arranged on the apparatus. The signals from the receivers 12 can be sensed automatically and serve to trigger-off vibrators when the level of the concrete is too high and to emit an acoustic signal for example when the concrete level is too low.

When a machine according to the invention is moved over a plastic concrete surface any irregularities therein will be smoothed out as a result of the down pressing effect of the machine resulting from the rolling motion, without any appreciable quantities of concrete being pressed forward in front of the machine. The machine will, instead, roll over any elevations and disperse the excess concrete in all directions, this action of the machine being amplified by the aforesaid vibrations.

FIGS. 4A–4C are part sectional views of the belt 3 and the drum 2 taken along the line IV—IV in FIG. 1. In the FIG. 4A embodiment a longitudinal body 13 is vulcanized in the belt along each of the longitudinal side edges thereof, so as to seal against the concrete and against the drums 1 and 2 and the side plates 4 arranged between said drums as shown in FIG. 8. The same effect has been achieved in the FIG. 4B embodiment by mounting strip-like rods 14 on the belt 3 along its longitudinally extending edges. The belt 3 of the FIG. 4C embodiment is provided with sealing lips 15 which slide against the drums and against the side plates of the machine. When the edges of the belt are made sufficiently high, the side plates may optionally be dispensed with.

FIG. 5 illustrates a further embodiment of the machine, in which the same references have been used to identify components corresponding to the previously described machine. In this embodiment, however, the drive motor 6 and the belt tensioning mechanism 8 have been omitted.

The machine illustrated in FIG. 5 is also intended to vacuum treat the concrete, in addition to smoothing or levelling the surface thereof. To this end the apparatus includes a suction box which co-acts with the belt 3 and which includes an upper plate 16 on which a vibrator 17 and a suction-source connector 18 are arranged. Arranged between the plate 16 and the belt 3, which in this embodiment has the form of a strainer or the like, is a vacuum distributing chamber, which includes, for example, a distance net 19 or the like. The net 19 must be capable of affording requisite support to the belt. Alternatively, a perforated plate or the like can form a support for the strainer, which may comprise wire gauze. The reference 20 identifies adjusting means with which the vertical position of the suction box can be adjusted.

FIG. 6 illustrates the suction box with vibrator 17 and the suction-source connection 18 from above, a part of the plate 16 having been cut away to illustrate the distance net 19 located in the vacuum distribution chamber. As will best be seen from the section shown in FIG. 7, the vacuum distribution chamber is defined by a sealing frame 21.

Thus, with a machine according to FIGS. 5–7 it is possible to continuously vacuum-treat concrete at the same time as the machine rolls over the surface thereof to smooth and level said surface. As a result of the rolling movement of the strainer belt 3 relative to the concrete it is possible to apply full vacuum even when moving the apparatus without any appreciable increase in the force required to move the apparatus. In order to achieve effective vacuum treatment, however, it may be suitable to operate the machine intermittently and to carry out vacuum treatment of the concrete under short stationary periods. In this case, the vibrator 17 serves to vibrate the belt 3 and therewith smooth and level the concrete more efficiently, as with the previously described embodiments. When the vibrator is used, water is released more readily from the concrete and thus vacuum treatment thereof is made more effective.

As beforementioned, the apparatus according to the invention normally exerts a very low surface pressure to the substratum. This pressure can be substantially increased, however, and caused to vary within wide limits depending on the vacuum applied. The effect on the substratum can also be amplified with the aid of vibrations.

A machine according to the invention can also be constructed as a driveable vehicle, in addition to the manually manouverable model illustrated in FIG. 3, the vehicle optionally having the same width as the joint spacing upon which the concrete is laid. In this way the laid concrete can be subsequently treated in an extremely rational manner. Optionally, the concrete may also be laid from a machine according to the invention, which can carry other form of means for subsequent treatment of the concrete.

In a machine fitted with a suction box according to FIG. 5 the suction box may also be utilized to facilitate movement of the machine, and in particular lateral movement thereof. To this end a low over-pressure is supplied to the suction box instead of vacuum such that an air cushion is formed beneath the belt which highly reduces the resistance to lateral movement. A certain polishing or grazing effect can be achieved by driving the belt at a speed faster than the machine is permitted to move.

In the aforegoing two embodiments of the invention have been described with reference to the highly schematic drawings. The invention can be modified, however, in several ways within the scope of the claims while retaining the central characteristic of producing a rolling motion between a belt in contact with the surface of the concrete and said surface at normally a very low surface pressure, which can be varied if so desired with the aid of underpressure and vibrations.

I claim:

1. A method for levelling and smoothing concrete when concreting large areas, characterized by providing a machine the bottom surface of which comprises a rotatable endless belt, providing sealing flanges along the longitudinally extending edges of said belt to prevent concrete from flowing over the surface of said belt opposite the surface thereof in contact with the concrete to thereby enable flotation of said machine on said concrete, floating said machine even on a highly fluid concrete mass which thus normally exerts very low surface pressure onto the substratum such that the machine is supported solely by the concrete, moving the machine over, while it floats on, the surface of the concrete to level and smooth the concrete as a result of the rolling motion between the surface of the concrete and the belt arranged on the machine and in contact with said concrete surface.

2. A method according to claim 1, characterized by amplifying the levelling and smoothing effect of the belt by vibrating a belt-supporting plate.

3. A method according to claim 2, characterized by controlling the levelling of the concrete by vibrating said plate with the aid of at least one vibrator controlled by level monitoring means.

4. A method according to any one of claims 1–3, characterized by vacuum treating the concrete in addition to levelling and smoothing the surface thereof, the aforesaid belt having the form of a strainer means which is at least partially supported by a suction box.

5. A method according to claim 4, characterized by vacuum treating the concrete surface continuously while moving the machine, or intermittently during short interruptions in movement of the machine.

6. A machine for levelling and smoothing concrete when concreting large areas, the machine being arranged to be moved over and in direct contact with the surface of the concrete and being supported solely by said concrete, characterized in that the bottom surface of the machine intended for contact with the concrete comprises an endless belt (3) which extends over two rotatable drums (1, 2), said belt being adapted to level and smooth the concrete during movement of the machine over the surface thereof as a result of rolling motion between the belt and the concrete surface and in that the belt (3) is provided along its longitudinally extending edges with sealing flanges (13–15) which flanges sealingly co-act with side portions (4) of the machine, whereby the machine floats even on highly fluid concrete mass.

7. A machine according to claim 6, characterized in that the belt (3) is supported by a plate capable of being vibrated.

8. A machine according to claim 7, characterized in that the plate is connected with at least one vibrator, (17) said vibrator being controlled by level monitoring means (11, 12).

9. A machine according to any one of claims 6–8, characterized in that the belt (3) is porous to comprise a strainer means which is at least partially supported by a suction box, to permit vacuum treatment of the concrete.

* * * * *